US011348507B2

(12) United States Patent
Li et al.

(10) Patent No.: US 11,348,507 B2
(45) Date of Patent: May 31, 2022

(54) METHOD AND APPARATUS FOR IDENTIFYING CURRENT

(71) Applicant: BOE Technology Group Co., Ltd., Beijing (CN)

(72) Inventors: Zhenzhen Li, Beijing (CN); Hui Zhao, Beijing (CN)

(73) Assignee: BOE Technology Group Co., LTD., Beijing (CN)

( * ) Notice: Subject to any disclaimer, the term of this patent is extended or adjusted under 35 U.S.C. 154(b) by 23 days.

(21) Appl. No.: 16/954,596

(22) PCT Filed: Jan. 17, 2020

(86) PCT No.: PCT/CN2020/072750
§ 371 (c)(1),
(2) Date: Jun. 17, 2020

(87) PCT Pub. No.: WO2020/151590
PCT Pub. Date: Jul. 30, 2020

(65) Prior Publication Data

US 2021/0217347 A1 Jul. 15, 2021

(30) Foreign Application Priority Data

Jan. 24, 2019 (CN) ..... 201910068442.2

(51) Int. Cl.
*G09G 3/20* (2006.01)

(52) U.S. Cl.
CPC ... *G09G 3/2003* (2013.01); *G09G 2320/0271* (2013.01); *G09G 2340/08* (2013.01)

(58) Field of Classification Search
CPC ..... G09G 2320/00–0295
See application file for complete search history.

(56) References Cited

U.S. PATENT DOCUMENTS

2005/0088379 A1 4/2005 Tsuchida
2012/0236041 A1 9/2012 Oh
(Continued)

FOREIGN PATENT DOCUMENTS

CN 105096788 A 11/2015
CN 105895013 A 8/2016
(Continued)

OTHER PUBLICATIONS

International search report of PCT application No. PCT/CN2020/072750 dated Apr. 3, 2020.
(Continued)

*Primary Examiner* — Roy P Rabindranath
(74) *Attorney, Agent, or Firm* — Fay Sharpe LLP

(57) ABSTRACT

A method for identifying a display current includes: acquiring grayscales of pixels in a to-be-displayed image, where the grayscale of each pixel includes grayscales of a plurality of color channels; calculating an average grayscale of a same color channel of all pixels in the to-be-displayed image; identifying a current value of each color channel and a current offset value of each color channel according to the average grayscale of each color channel, where the current offset value represents a difference between a display current value of a nonmonochromatic image and a display current sum of monochromatic images corresponding to the nonmonochromatic image; and calculating a display current of the to-be-displayed image based on the current value and the current offset value of each color channel.

20 Claims, 3 Drawing Sheets

(56) References Cited

U.S. PATENT DOCUMENTS

| | | | |
|---|---|---|---|
| 2016/0240140 | A1 | 8/2016 | Park |
| 2017/0124947 | A1 | 5/2017 | Kim |
| 2020/0051508 | A1 | 2/2020 | Tan |

FOREIGN PATENT DOCUMENTS

| | | | |
|---|---|---|---|
| CN | 106531070 | A | 3/2017 |
| CN | 106782303 | A | 5/2017 |
| CN | 106847171 | A | 6/2017 |
| CN | 107767815 | A | 3/2018 |
| CN | 108257557 | A | 7/2018 |
| CN | 108281107 | A | 7/2018 |
| CN | 108877676 | A | 11/2018 |
| CN | 109473059 | A | 3/2019 |

OTHER PUBLICATIONS

First office action of Chinese application No. 201910068442.2 dated Mar. 4, 2020.

METHOD AND APPARATUS FOR IDENTIFYING CURRENT

CROSS-REFERENCE TO RELATED APPLICATION

The present application is a 371 of PCT Application No. PCT/CN2020/072750, filed on Jan. 17, 2020, which claims priority to Chinese Patent Application No. 201910068442.2 on Jan. 24, 2019 and entitled "METHOD AND APPARATUS FOR IDENTIFYING DISPLAY CURRENT, DISPLAY COMPENSATION METHOD AND APPARATUS, DISPLAY APPARATUS, AND STORAGE MEDIUM", the contents of which are incorporated herein by reference in its entirety.

TECHNICAL FIELD

The present disclosure relates to the field of display technologies, and in particular, relates to a method for identifying a display current, an apparatus for identifying a display current, a display compensation method and apparatus, a display apparatus, and a storage medium.

BACKGROUND

When a display panel displays an image, under the presence of resistance in a signal line, when a power supply (ELVDD) supplies the same voltage to two pixel units that are distal from each other, a voltage at the pixel unit more proximal to the power supply is actually higher than that that at the pixel unit more distal from the power supply. Such a phenomenon is referred to as a power supply drop (IR drop).

To eliminate the impact of the IR drop, it is necessary to compensate for the IR drop. One method for compensating for an IR drop is based on a display current for displaying an image, and a next displayed frame of image is compensated according to the display current and the distances from the pixel units to the power supply. The display current herein is a sum of currents in current output channels on a display panel, for example, a sum of currents in a red (R) channel, a green (G) channel, and a blue (B) channel.

In the above compensation solution, a display current for displaying an image is acquired in real time by a current sensor disposed on the display panel, and a current value acquired by the current sensor in real time is used as an input for compensating for a next frame of image. In this solution, the weight of the display panel is increased, and hardware costs of the display panel are further increased.

SUMMARY

Embodiments of the present disclosure provide a method for identifying a display current, an apparatus for identifying a display current, a display compensation method and apparatus, a display apparatus, and a storage medium.

At least one embodiment of the present disclosure provides a method for identifying a display current. The method includes:

acquiring grayscales of pixels in a to-be-displayed image, wherein the grayscale of each pixel includes grayscales of a plurality of color channels;

calculating an average grayscale of a same color channel of all pixels in the to-be-displayed image;

identifying a current value of each color channel and a current offset value of each color channel according to the average grayscale of each color channel, wherein the current offset value represents a difference between a display current value of a nonmonochromatic image and a display current sum of monochromatic images corresponding to the nonmonochromatic image, the monochromatic images corresponding to the nonmonochromatic image are monochromatic images corresponding to color channels required to display the nonmonochromatic image, and the display current sum is a sum of display current values of the monochromatic images; and calculating a display current of the to-be-displayed image based on the current value and the current offset value of each color channel.

In one implementation of embodiments of the present disclosure, identifying the current offset value of each color channel according to the average grayscale of each color channel includes:

identifying a current value corresponding to the average grayscale of each color channel according to a corresponding relationship between the grayscale and the current value, wherein the corresponding relationship between the grayscale and the current value includes corresponding relationships between the grayscales and the current values of all the color channels; and identifying a current offset value corresponding to the average grayscale of each color channel according to a corresponding relationship between the grayscale and the current offset value, wherein the corresponding relationship between the grayscale and the current offset value includes corresponding relationships between the grayscales and the current offset values of all the color channels.

In one implementation of embodiments of the present disclosure, the grayscale of each pixel includes grayscales of N+1 color channels, wherein N is an integer greater than 1; and identifying the current offset value corresponding to the average grayscale of each color channel according to the corresponding relationship between the grayscale and the current offset value includes:

when a quantity of color channels whose average grayscale is 0 is equal to N, identifying that the current offset value of each color channel is 0; and when a quantity of color channels whose average grayscale is 0 is less than N, identifying the current offset value corresponding to the average grayscale of each color channel according to the corresponding relationship between the grayscale and the current offset value.

In one implementation of embodiments of the present disclosure, calculating the display current of the to-be-displayed image based on the current value and the current offset value of each color channel includes:

calculating a sum of the current values of all the color channels, to obtain a total channel current;

calculating a sum of the current offset values of all the color channels, to obtain a total current offset value; and calculating a difference between the total channel current and the total current offset value, to obtain the display current of the to-be-displayed image.

In one implementation of embodiments of the present disclosure, the method further includes:

acquiring grayscale test data, wherein the grayscale test data includes current values for displaying a predetermined color image at predetermined grayscales by sample pixel units on a panel under test;

calculating the current offset values of the color channels at the predetermined grayscales according to the grayscale test data; and performing interpolation and supplementation based on the current offset values of the color channels at the predetermined grayscales, to obtain the current offset values of the color channels at all the gray scales.

In one implementation of embodiments of the present disclosure, the predetermined color image includes white (W), red (R), green (G), blue (B), cyan (C), magenta (M), and yellow (Y) images, and calculating the current offset values of the color channels at the predetermined grayscales according to the grayscale test data includes:

calculating the current offset values of the color channels according to the following formula:

$$\begin{cases} deltaR = (I_R + I_G + I_B - I_W) - (I_G + I_B - I_C) \\ deltaG = (I_R + I_G + I_B - I_W) - (I_R + I_B - I_M), \\ deltaB = (I_R + I_G + I_B - I_W) - (I_R + I_G - I_Y) \end{cases}$$

wherein deltaR is a current offset value of an R channel, deltaG is a current offset value of a G channel, deltaB is a current offset value of a B channel, I_R is a display current value for displaying the R image, I_G is a display current value for displaying the G image, I_B is a display current value for displaying the B image, I_W is a display current value for displaying the W image, I_C is a display current value for displaying the C image, I_M is a display current value for displaying the M image, and I_Y is a display current value for displaying the Y image.

At least one embodiment of the present disclosure provides a display compensation method. The method includes:

identifying a display current of a to-be-displayed image by using the method aforesaid; obtaining an image compensation grayscale based on the display current of the to-be-displayed image and a corresponding relationship between a display current and the image compensation grayscale; and compensating a picture of a next frame of image of the to-be-displayed image by using the image compensation grayscale.

At least one embodiment of the present disclosure provides an apparatus for identifying a display current. The apparatus includes:

a processor and a memory configured to store at least one instruction executable by the processor, wherein the processor is configured to:

acquire grayscales of pixels in a to-be-displayed image, wherein the grayscale of each pixel includes grayscales of a plurality of color channels;

calculate an average grayscale of a same color channel of all pixels in the to-be-displayed image;

identify a current value of each color channel and a current offset value of each color channel according to the average grayscale of each color channel, wherein the current offset value represents a difference between a display current value of a nonmonochromatic image and a display current sum of monochromatic images corresponding to the nonmonochromatic image, the monochromatic images corresponding to the nonmonochromatic image are monochromatic images corresponding to color channels required to display the nonmonochromatic image, and the display current sum is a sum of display current values of the monochromatic images; and calculate a display current of the to-be-displayed image based on the current value and the current offset value of each color channel.

At least one embodiment of the present disclosure provides a display compensation apparatus. The apparatus includes: a processor and a memory configured to store an instruction executable by the processor, wherein the processor is configured to:

identify a display current of a to-be-displayed image by using the method as described above; obtain an image compensation grayscale based on the display current of the to-be-displayed image and a corresponding relationship between a display current and an image compensation grayscale; and compensate a picture of a next frame of image of the to-be-displayed image by using the image compensation grayscale.

At least one embodiment of the present disclosure provides a display apparatus. The display apparatus includes the apparatus for identifying a display current as described above.

At least one embodiment of the present disclosure provides a storage medium. The storage medium includes at least one instruction, and the at least one instruction is executed by a processor to perform any method for identifying a display current as described above.

At least one embodiment of the present disclosure provides a storage medium. The storage medium includes at least one instruction, and the at least one instruction is executed by a processor to perform the display compensation method as described above.

DETAILED DESCRIPTION

For clearer descriptions of the objects, technical solutions and advantages in the present disclosure, the implementation of the present disclosure is described in detail below in combination with the accompanying drawings.

A display panel includes a plurality of pixel units, and each pixel unit includes a plurality of sub-pixel units. One pixel unit may display one pixel in an image. When displaying an image, the display panel needs to acknowledge grayscales of pixels in the image. The grayscale of each pixel includes grayscales of a plurality of color channels. The plurality of color channels one-to-one correspond to a plurality of sub-pixel units in one pixel unit.

Grayscales of a plurality of color channels of one pixel may respectively control light-emitting luminance of a plurality of sub-pixel units in one pixel unit, such that light of different colors emitted by the plurality of sub-pixel units is mixed to obtain a color corresponding to the pixel.

For the entire display panel, one same drive chip supplies currents required by one same color channel of pixel units. Therefore, during the display of an image, a sum of currents of a plurality of color channels is a display current for displaying the image.

Figure 1:
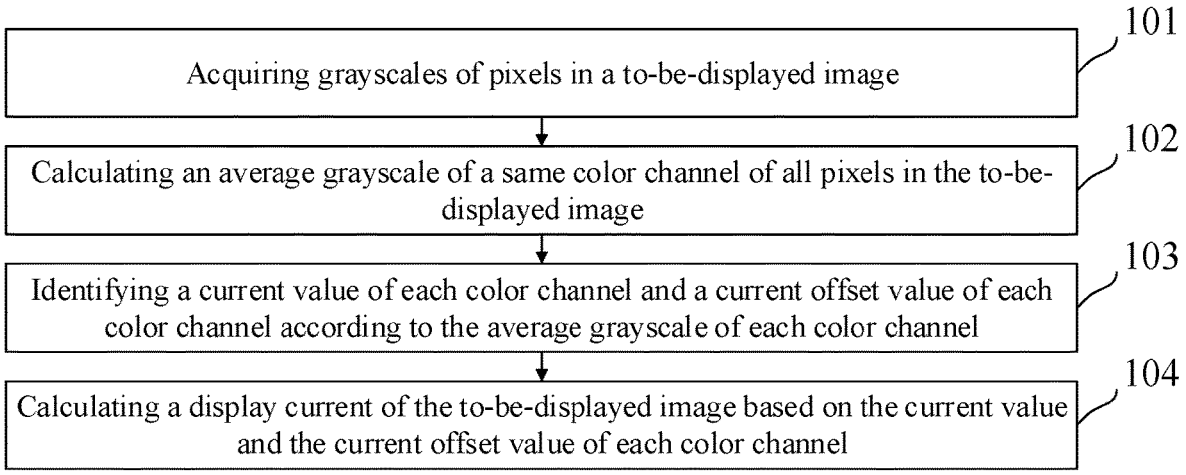
FIG. 1 is a flowchart of a method for identifying a display current according to an embodiment of the present disclosure.

FIG. 1 is a flowchart of a method for identifying a display current according to an embodiment of the present disclosure. Referring to FIG. 1, the method includes the following steps:

In step 101, grayscales of pixels in a to-be-displayed image are acquired.

In this embodiment of the present disclosure, the to-be-displayed image herein may be at least one frame of image that is about to be displayed. Each frame of image includes a plurality of pixels. Each pixel is displayed by a plurality of sub-pixel units on a display panel. Each sub-pixel unit corresponds to one color channel, and a drive chip corresponding to the color channel supplies a voltage to the sub-pixel unit.

The grayscale of each pixel includes grayscales of color channels. For example, the grayscale of each pixel includes grayscales of the color channels including R, G, and B channels, or, the grayscale of each pixel includes grayscales of four color channels including R, G, B, and white (W) channels.

In step 102, an average grayscale of a same color channel of all pixels in the to-be-displayed image is calculated.

After grayscales of color channels of each pixel are obtained, grayscales of a same color channel of all the pixels are added and averaged to obtain an average grayscale of the color channel.

For example, grayscales of the R channel of all the pixels are added and averaged to obtain an average grayscale of the R channel; grayscales of the G channel of all the pixels are added and averaged to obtain an average grayscale of the G channel; and grayscales of the B channel of all the pixels are added and averaged to obtain an average grayscale of the B channel.

In step 103, a current value of each color channel and a current offset value of each color channel are identified according to the average grayscale of each color channel, where the current offset value represents a difference between a display current value of a nonmonochromatic image and a display current sum of monochromatic images corresponding to the nonmonochromatic image, the monochromatic images corresponding to the nonmonochromatic image are monochromatic images corresponding to color channels required to display the nonmonochromatic image, and the display current sum is a sum of display current values of the monochromatic images.

During working, there is no current offset phenomenon only when the display panel displays an image in a color corresponding to a single color channel, for example, displays an R, G or B image. When the display panel displays an image in colors corresponding to two or more color channels, there is a current offset. The current offset is a difference between a current for displaying a nonmonochromatic image and a sum of currents for displaying monochromatic images corresponding to the nonmonochromatic image. The current offset is caused by a factor such as an IR drop.

The monochromatic images herein are images corresponding to color channels, for example, three monochromatic R, G and B images that respectively correspond to the R, G and B color channels. Each monochromatic image is a pure color image in a color of only one color channel.

In the display panel, a corresponding relationship between a grayscale and a current value is calibrated in advance for each color channel, and current values of color channels may be identified according to the calibrated corresponding relationship.

The current offset values of the color channels may also be identified according to a corresponding relationship between the grayscale and the current offset value, and the corresponding relationship between the grayscale and the current offset value may be obtained in advance by testing and calculation.

In step 104, a display current of the to-be-displayed image is calculated based on the current value and the current offset value of each color channel.

In the step, after the current values of the color channels and the current offset values of the color channels are obtained, the display current of the to-be-displayed image may be calculated according to a difference between a sum of the current values of all the color channels and a sum of the current offset values of all the color channels.

The display current is a sum of currents output by the color channels when the display panel displays the to-be-displayed image, that is, a sum of currents of the R channel, the G channel, and the B channel.

In this embodiment of the present disclosure, grayscales of pixels in a to-be-displayed image are acquired, an average grayscale of each color channel is then calculated according to the grayscales of the pixels in the to-be-displayed image, a current value of each color channel and a current offset value of each color channel are calculated according to the average grayscale of each color channel, where the current offset value herein represents a difference between a display current value of a nonmonochromatic image and a display current sum of monochromatic images corresponding to the nonmonochromatic image, and the display current sum is a sum of display current values of the monochromatic images, and a display current of the to-be-displayed image may then be obtained based on the current value and the current offset value of each color channel. In the prediction solution, the process is simple, a difference between an ideal state and actual display is considered in a calculation process, and a calculated result is accurate and can be used as the basis for picture compensation. In addition, the solution is implemented by using an algorithm, and a current sensor does not need to be disposed, thereby reducing the weight and hardware costs of a display panel.

Figure 2:
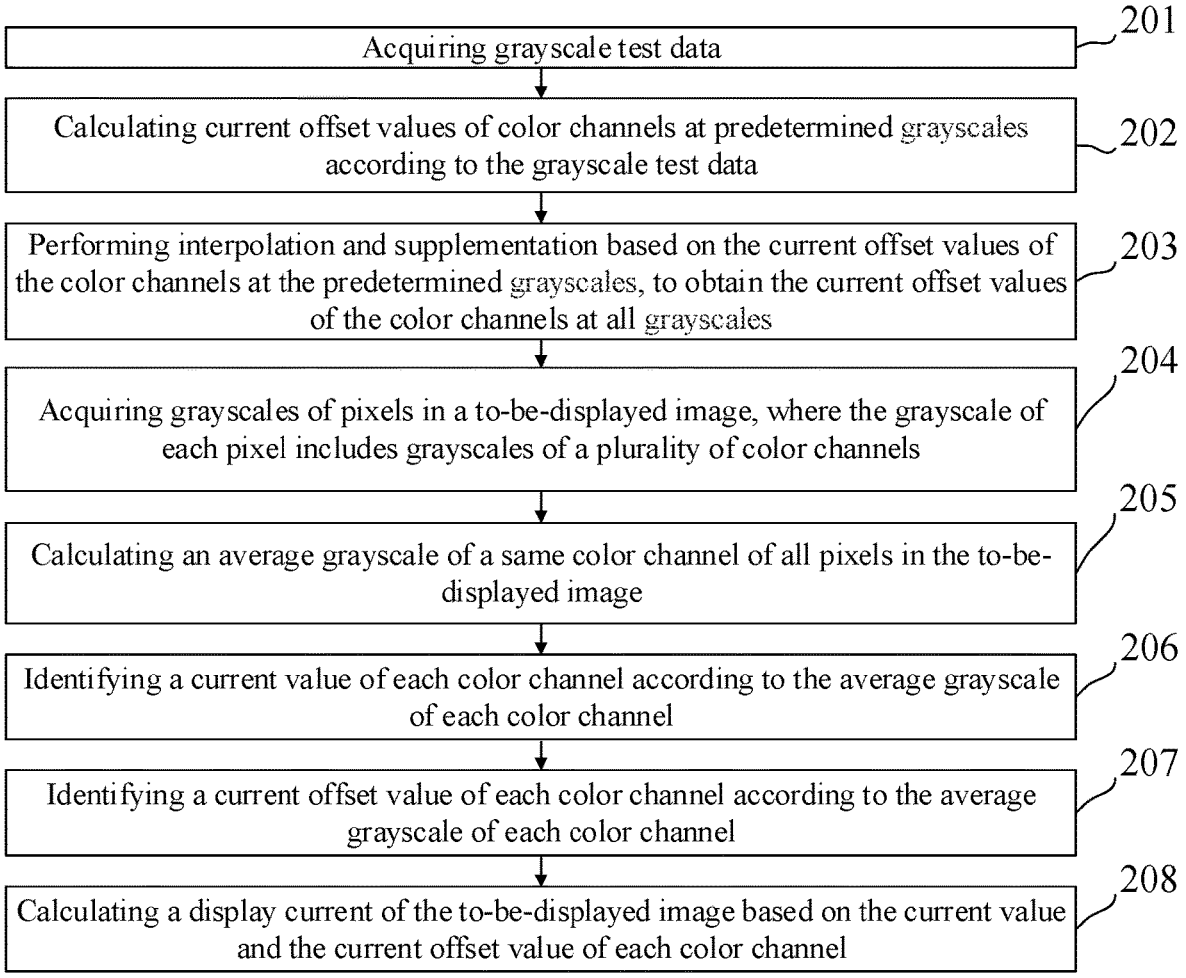
FIG. 2 is a flowchart of another method for identifying a display current according to an embodiment of the present disclosure.

FIG. 2 is a flowchart of another method for identifying a display current according to an embodiment of the present disclosure. Referring to FIG. 2, the method includes the following steps:

In step 201, grayscale test data is acquired, wherein the grayscale test data includes current values for displaying a predetermined color image at predetermined grayscales by sample pixel units on a panel under test.

Herein, the predetermined color image includes W, R, G, B, cyan (C), magenta (M), and yellow (Y) color images.

For example, particular sample pixel units are first chosen on the panel under test (for example, pixel units are uniformly chosen on the panel under test), and particular sample grayscales are then chosen from grayscales 0 to 255 as predetermined grayscales (for example, a grayscale 0, a grayscale 255, and several grayscales chosen between 0 and 255), and the predetermined color image is then displayed to obtain the current values for displaying the predetermined color image at the predetermined grayscales. The panel under test herein and a subsequently used display panel are panels of the same model.

For example, W, R, G, and B, C, M, and Y images are sequentially displayed on the panel under test at the predetermined grayscales, and during the display of these images, a current sensor in a light-on device (a panel test device) reads and displays current values.

The predetermined color image herein further includes an W image, an C image, an M image, and an Y image in addition to R, G, and B color images. W is formed by R, G, and B with the same grayscale. C is formed by G and B with the same grayscale. M is formed by R and B with the same grayscale. Y is formed by R and G with the same grayscale.

No current offset phenomenon is caused only when the display panel displays an image in a color corresponding to a single color channel (a monochromatic image), for example, displays an R, G, or B image, which may be considered as an ideal state. When the display panel displays an image in colors corresponding to two or more color channels (a nonmonochromatic image), a current offset is present, which may be considered as an actual state. For identification of the display current of the display panel, a value of the current offset, that is, a current offset value, needs to be identified. The current offset value represents a difference between a display current value of a nonmonochromatic image and a display current sum of monochromatic images corresponding to the nonmonochromatic image. The display current sum is a sum of display current values of the monochromatic images. The current offset value may be calculated according to steps 202 and 203.

In step 202, current offset values of color channels at the predetermined grayscales are calculated according to the grayscale test data.

The step may include: calculating the current offset values of the color channels according to the following formulas:

$$\begin{cases} deltaR = (I_R + I_G + I_B - I_W) - (I_G + I_B - I_C) \\ deltaG = (I_R + I_G + I_B - I_W) - (I_R + I_B - I_M), \\ deltaB = (I_R + I_G + I_B - I_W) - (I_R + I_G - I_Y) \end{cases}$$

where deltaR is a current offset value of an R channel, deltaG is a current offset value of a G channel, deltaB is a current offset value of a B channel, I_R is a display current value for displaying the R image, I_G is a display current value for displaying the G image, I_B is a display current value for displaying the B image, I_W is a display current value for displaying the W image, I_C is a display current value for displaying the C image, I_M is a display current value for displaying the M image, and I_Y is a display current value for displaying the Y image. These display current values are tested in step 201:

In the formula, is used to obtain a sum of current offset values of the R, G and B color channels is obtained by I_R+I_G+I_B−I_W, a sum of the current offset values of the G channel and the B channel is obtained by I_G+I_B−I_C, and the current offset value of the R channel is obtained by (I_R+I_G+I_B−I_W)−(I_G+I_B−I_C). Similarly, the current offset values of the (3 channel and the B channel may be obtained.

The current offset values of the R, G, and B color channels are calculated by using the foregoing formula. Display panels have different structures. Some display panels further include a channel W. A current offset value of the channel W is obtained:

$$deltaW = \frac{I_C + I_M + I_Y}{2} - I_W.$$

In step 203, interpolation and supplementation are performed based on the current offset values of the color channels at the predetermined grayscales, to obtain the current offset values of the color channels at all grayscales.

Since only the current offset values of the color channels at the predetermined grayscales are obtained in step 202, in this case, the current offset values of the color channels at the grayscales 0 to 255 may be complemented in an interpolation manner. The interpolation manner herein includes, but is not limited to, linear interpolation, curve-fitting interpolation, and the like.

By means of steps 201 to 203, corresponding relationships between the grayscales and the current offset values of sub-pixels are obtained, and the corresponding relationships are locally stored (for example, in a memory, i.e., a read-only memory (ROM) for use in subsequent calculation.

In step 204, grayscales of pixels in a to-be-displayed image are acquired, where the grayscale of each pixel includes grayscales of a plurality of color channels.

In this embodiment of the present disclosure, the to-be-displayed image herein may be at least one frame of image that is about to be displayed. Each frame of image includes a plurality of pixels. Each pixel is displayed by a plurality of sub-pixel units on the display panel. Each sub-pixel unit corresponds to one color channel, and a drive chip corresponding to the color channel supplies a voltage to the sub-pixel unit.

The grayscale of each pixel includes grayscales of color channels. For example, the grayscale of each pixel includes grayscales of the R, G, and B color channels, or, the grayscale of each pixel includes grayscales of the R, G, B, and W color channels.

In step 205, an average grayscale of a same color channel of all pixels in the to-be-displayed image is calculated.

After grayscales of color channels of each pixel are obtained, grayscales of a same color channel of all the pixels are added and averaged to obtain an average grayscale of the color channel.

For example, grayscales of the R channel of all the pixels are added and averaged to obtain an average grayscale of the R channel; grayscales of the G channel of all the pixels are added and averaged to obtain an average grayscale of the G channel; and grayscales of the B channel of all the pixels are added and averaged to obtain an average grayscale of the B channel.

In step 206, a current value of each color channel is identified according to the average grayscale of each color channel.

In the display panel, a corresponding relationship between the grayscale and the current value is calibrated in advance for each color channel, and the current value of each color channel may be identified according to the calibrated corresponding relationship.

For example, the step may include: identifying a current value corresponding to the average grayscale of each color channel according to the corresponding relationship between the grayscale and the current value.

The corresponding relationship between the grayscale and the current value includes corresponding relationships between the grayscales and the current values of all the color channels. Therefore, the current values corresponding to the average grayscales of the color channels may be identified respectively according to the corresponding relationships between the grayscales and the current values of all the color channels.

In step 207, a current offset value of each color channel is identified according to the average grayscale of each color channel.

The current offset values of the color channels may be identified according to a corresponding relationship between the grayscale and the current offset value. The corresponding relationship between the grayscale and the current offset value has been measured in advance and stored locally. That is, the step may include: identifying a current offset value corresponding to the average grayscale of each color channel according to the corresponding relationship between the grayscale and the current offset value, where the corresponding relationship between the grayscale and the current offset value includes corresponding relationships between the grayscales and the current offset value of all the color channels.

The grayscale of each pixel includes grayscales of N+1 color channels, where N is an integer greater than 1.

The step may include: when a quantity of color channels whose average grayscale is 0 is equal to N, identifying that the current offset value of each color channel is 0; and when a quantity of color channels whose average grayscale is 0 is less than N, identifying that the current offset value corresponding to the average grayscale of each color channel according to the corresponding relationship between the grayscale and the current offset value.

That is, it is identified whether there are N color channels whose average grayscale is 0, which is used as a basis for identifying the current offset value.

For example, when the grayscale of each pixel includes grayscales of the R, G and B color channels, it is identified whether there are two color channels whose average grayscale is 0. If there are two color channels whose average grayscale is 0, it is identified that the current offset values of the R, G, and B channels are all 0.

Since no offset current is present when the display panel displays an image in a color corresponding to a single color channel, that is, the current offset value is 0, when N color channels whose average grayscale is 0 are present, that is, an image in a color corresponding to a single color channel is displayed, it is identified that the current offset values of the color channels are all 0.

On the contrary, if the N color channels whose average grayscale is 0 are not present, current offset values corresponding to average grayscales of the color channels are identified according to the corresponding relationship between the grayscale and the current offset value.

The corresponding relationship between the grayscale and the current offset value includes corresponding relationships between the grayscales and the current offset values of all the color channels, and the current offset values corresponding to the average grayscales of the color channels may be identified respectively according to the corresponding relationships between the grayscales and the current offset values of all the color channels.

For example, a current offset value of the R channel corresponding to an average grayscale of the R channel is identified according to the corresponding relationship between the grayscale and the current offset value of the R channel; a current offset value of the G channel corresponding to an average grayscale of the G channel is identified according to the corresponding relationship between the grayscale and the current offset value of the G channel; and a current offset value of the B channel corresponding to an average grayscale of the B channel is identified according to the corresponding relationship between the grayscale and the current offset value of the B channel.

In step 208, a display current of the to-be-displayed image is calculated based on the current value and the current offset value of each color channel.

The method may include: calculating a sum of the current values of all the color channels, to obtain a total channel current; calculating a sum of the current offset values of all the color channels, to obtain a total current offset value; and calculating a difference between the total channel current and the total current offset value, to obtain the display current of the to-be-displayed image.

A display panel with R, G, and B channels is used as an example. In the step, a display current I may be calculated according to the following formula:

$$I=I_R+I_G+I_B-\text{delta}R_\text{delta}G-\text{delta}B$$

After the display current is calculated, the display panel may use the display current to make compensation for an IR drop.

Steps 204 to 208 may be performed after a demura step in a display process.

The method for identifying the display current according to this embodiment of the present disclosure may be applied to display panels in various forms, which include, but are not limited to, an organic light-emitting diode (OLED), a liquid crystal display (LCD), and the like.

Figure 3:
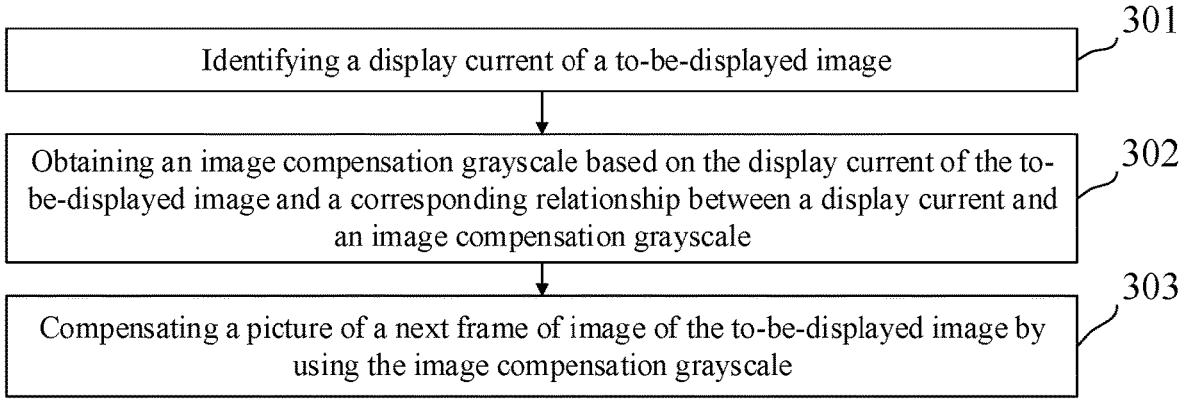
FIG. 3 is a flowchart of a display compensation method according to an embodiment of the present disclosure.

FIG. 3 is a flowchart of a display compensation method according to an embodiment of the present disclosure. Referring to FIG. 3, the method includes the following steps:

In step 301, a display current of a to-be-displayed image is identified.

Step 301 may be practiced by using the step shown in FIG. 1 or the step shown in FIG. 2.

In step 302, an image compensation grayscale is obtained based on the display current of the to-be-displayed image and a corresponding relationship between the display current and the image compensation grayscale.

In this embodiment of the present disclosure, the corresponding relationship between the display current and the image compensation grayscale may be stored in the form of a compensation grayscale lookup table.

The step may include: when the display current of the to-be-displayed image is identified, searching the compensation grayscale lookup table for an image compensation grayscale by using the display current of the to-be-displayed image as an index. The image compensation grayscale found herein is an image compensation grayscale for one or more predetermined areas in the display panel, and an image compensation gray scale for another area may be calculated according to the image compensation grayscale found herein.

The display panel may be divided into a plurality of areas according to distances from a power supply. A pixel displayed in each area may be compensated by using a same image compensation grayscale, to facilitate storage of the compensation grayscale lookup table and calculation of an image compensation grayscale. Therefore, after the image compensation grayscale for one or more areas is identified, image compensation grayscales for other areas may be calculated according to distances relationship between these areas. When an area is more proximal to the power supply, the image compensation grayscale is smaller. For example, the display panel is divided into three areas, and the compensation grayscale lookup table only stores an image compensation grayscale for an area that is most distal from the power supply at different display currents. At a display current, it is found that the image compensation gray scale for the area that is most distal from the power supply is 4

(that is, the original grayscale is added by 4), such that according to distances from the power supply, it may be calculated that image compensation grayscales for two other areas in ascending order of distance are respectively −4 and 0.

The compensation grayscale lookup table herein includes image compensation grayscales that are identified in advance through tests and corresponds to one or more areas at various display currents.

In step 303, a picture of a next frame of image of the to-be-displayed image is compensated by using the image compensation grayscale.

The calculated image compensation grayscale and the grayscale of the next frame of image are added to obtain the compensated grayscale. The compensated grayscale is used to control the display panel to display the picture of the next frame of image.

Because it takes some time to calculate the image compensation grayscale, it is very difficult to compensate a current frame, and a next frame of image is compensated.

Figure 4:
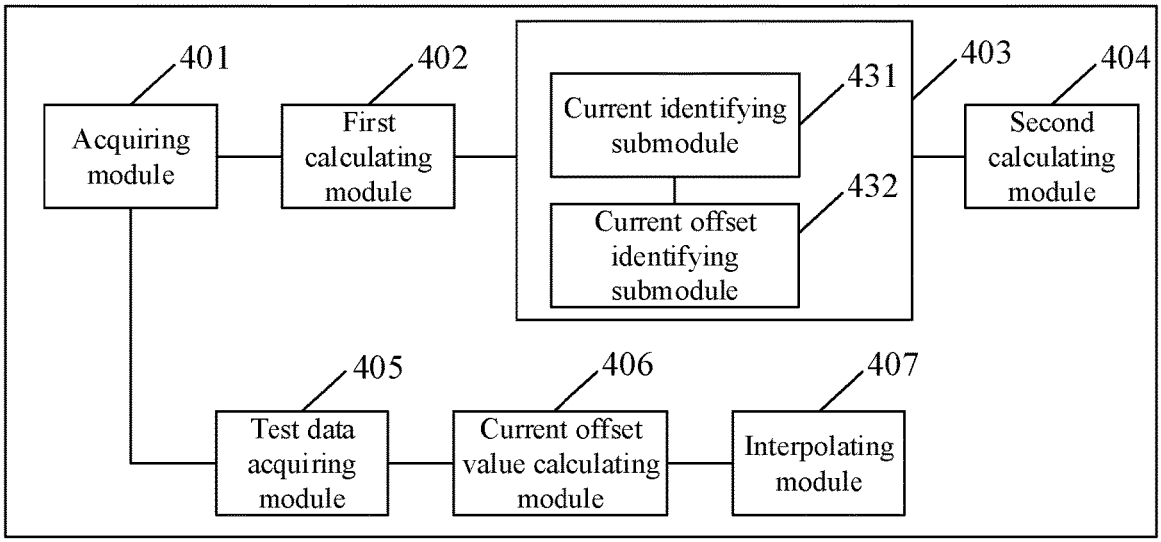
FIG. 4 is a schematic structural diagram of an apparatus for identifying a display current according to an embodiment of the present disclosure.

FIG. 4 is a schematic structural diagram of an apparatus for identifying a display current according to an embodiment of the present disclosure. Referring to FIG. 4, the apparatus includes an acquiring module 401, a first calculating module 402, an identifying module 403, and a second calculating module 404.

The acquiring module 401 is configured to acquire grayscales of pixels in a to-be-displayed image, where the grayscale of each pixel includes grayscales of a plurality of color channels. The first calculating module 402 is configured to calculate an average grayscale of a same color channel of all pixels in the to-be-displayed image. The identifying module 403 is configured to identify a current value of each color channel and a current offset value of each color channel according to the average grayscale of each color channel, where the current offset value represents a difference between a display current value of a nonmonochromatic image and a display current sum of monochromatic images corresponding to the nonmonochromatic image, the monochromatic images corresponding to the nonmonochromatic image are monochromatic images corresponding to color channels required to display the nonmonochromatic image, and the display current sum is a sum of display current values of the monochromatic images. The second calculating module 404 is configured to calculate a display current of the to-be-displayed image based on the current value and the current offset value of each color channel.

In an implementation of this embodiment of the present disclosure, the identifying module 403 includes:

a current identifying submodule 431, configured to identify a current value corresponding to the average grayscale of each color channel according to a corresponding relationship between the grayscale and the current value, where the corresponding relationship between the grayscale and the current value includes corresponding relationships between the gray scales and the current values of all the color channels; and a current offset identifying submodule 432, configured to identify a current offset value corresponding to the average grayscale of each color channel according to a corresponding relationship between the grayscale and the current offset value, where the corresponding relationship between the grayscale and the current offset value includes corresponding relationships between the grayscales and the current offset values of all the color channels.

Optionally, the grayscale of each pixel includes grayscales of N+1 color channels, where N is an integer greater than 1; and the current offset identifying submodule 432 is configured to: when a quantity of color channels whose average grayscale is 0 is equal to N, identify that the current offset value of each color channel is 0; and when a quantity of color channels whose average grayscale is 0 is less than N, identify the current offset value corresponding to the average grayscale of each color channel according to the corresponding relationship between the grayscale and the current offset value.

In an implementation of this embodiment of the present disclosure, the second calculating module 404 is configured to:

calculate a sum of the current values of all the color channels, to obtain a total channel current;

calculate a sum of the current offset values of all the color channels, to obtain a total current offset value; and calculate a difference between the total channel current and the total current offset value, to obtain the display current of the to-be-displayed image.

Optionally, the apparatus further includes:

a test data acquiring module 405, configured to acquire grayscale test data, wherein the grayscale test data includes current values for displaying a predetermined color image at predetermined grayscales by sample pixel units on a panel under test;

a current offset value calculating module 406, configured to calculate the current offset values of the color channels at the predetermined grayscales according to the grayscale test data; and an interpolating module 407, configured to perform interpolation and supplementation based on the current offset values of the color channels at the predetermined grayscales, to obtain the current offset values of the color channels at all the grayscales.

Optionally, the predetermined color image includes W, R, G, B, C, M, and Y images, and the current offset value calculating module 406 is configured to calculate the current offset values of the color channels according to the following formulas:

$$\begin{cases} deltaR = (I_R + I_G + I_B - I_W) - (I_G + I_B - I_C) \\ deltaG = (I_R + I_G + I_B - I_W) - (I_R + I_B - I_M), \\ deltaB = (I_R + I_G + I_B - I_W) - (I_R + I_G - I_Y) \end{cases}$$

where deltaR is a current offset value of an R channel, deltaG is a current offset value of a G channel, deltaB is a current offset value of a B channel, I_R is a display current value for displaying the R image, I_G is a display current value for displaying the G image, I_B is a display current value for displaying the B image, I_W is a display current value for displaying the W image, I_C is a display current value for displaying the C image, I_M is a display current value for displaying the M image, and I_Y is a display current value for displaying the Y image.

It should be noted that the apparatus for identifying the display current according to the above embodiment only takes division of all the functional modules as an example for explanation when identifying a display current. In practice, the above functions can be finished by the different functional modules as required. That is, the internal structure of the apparatus is divided into different functional modules to finish all or part of the functions described above. In addition, the apparatus for identifying the display current according to the above embodiment has the same concept as the method for identifying the display current according to the above embodiment. For the specific implementation process of the apparatus, reference may be made to the method embodiments, which is not repeated herein.

Figure 5:
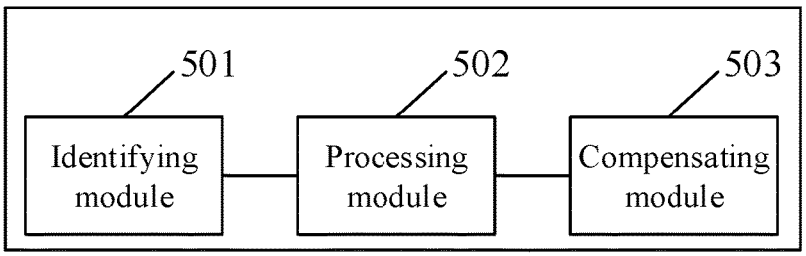
FIG. 5 is a schematic structural diagram of a display compensation apparatus according to an embodiment of the present disclosure.

FIG. 5 is a schematic structural diagram of a display compensation apparatus according to an embodiment of the present disclosure. Referring to FIG. 5, the apparatus includes an identifying module 501, a processing module 502, and a compensating module 503.

The identifying module 501 is configured to identify a display current of a to-be-displayed image by using the method shown in FIG. 1 or FIG. 2. The processing module 502 is configured to obtain an image compensation grayscale based on the display current of the to-be-displayed image and a corresponding relationship between a display current and an image compensation grayscale. The compensating module 503 is configured to compensate a picture of a next frame of image of the to-be-displayed image by using the image compensation grayscale.

It should be noted that the display compensation apparatus according to the above embodiment only takes division of all the functional modules as an example for explanation when realizing display. In practice, the above functions can be finished by the different functional modules as required. That is, the internal structure of the apparatus is divided into different functional modules to finish all or part of the functions described above. In addition, the display compensation apparatus according to the above embodiment has the same concept as the display compensation method according to the foregoing embodiment. For the specific implementation process of the apparatus, reference may be made to the method embodiments, which is not repeated herein.

Figure 6:
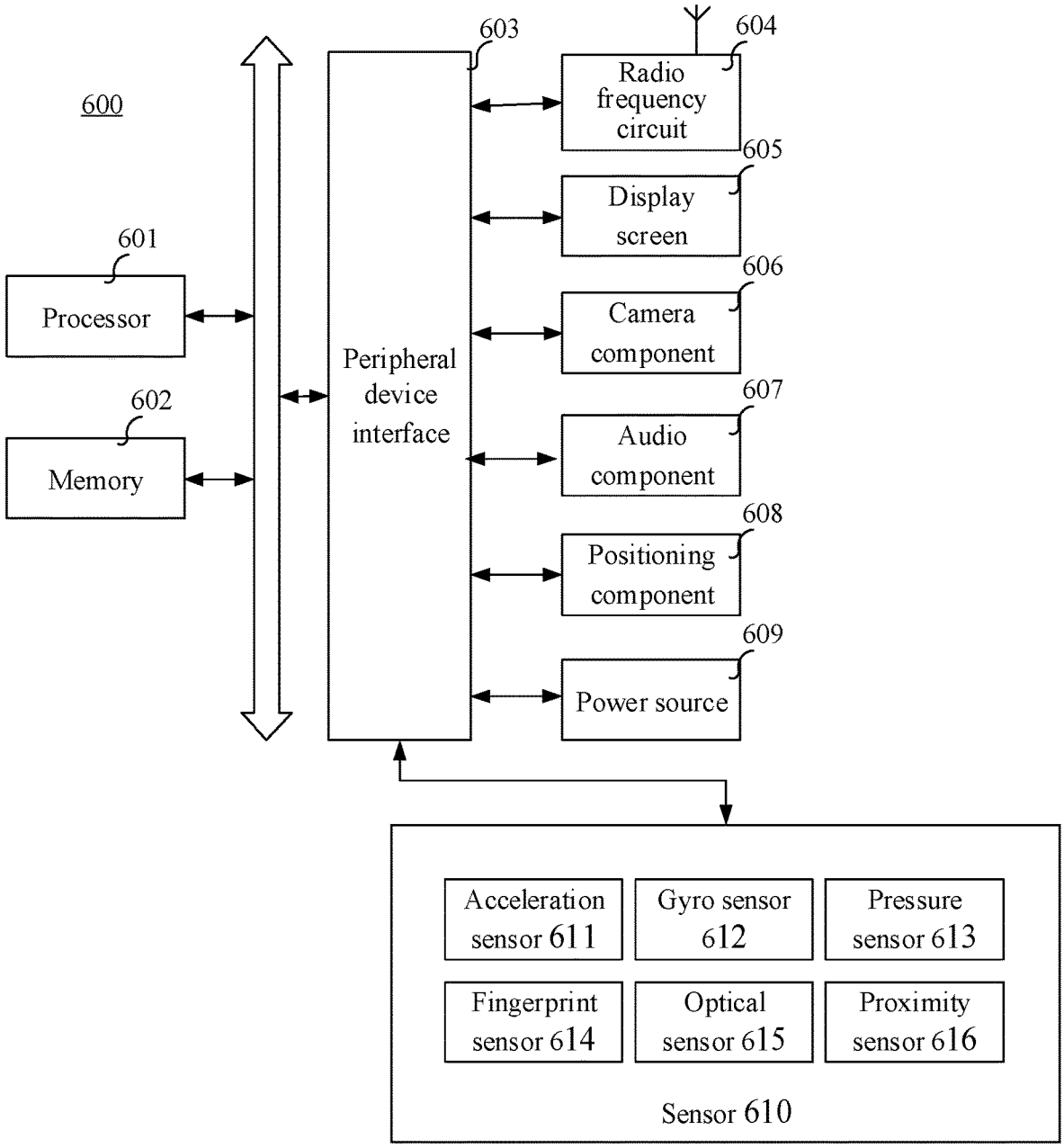
FIG. 6 is a structural block diagram of an apparatus for identifying a display current/a display compensation apparatus according to an embodiment of the present disclosure.

FIG. 6 is a structural block diagram of a display current identifying/display compensation apparatus 600 according to an exemplary embodiment of the present disclosure. Generally, the apparatus 600 includes a processor 601 and a memory 602.

The processor 601 may include one or more processing cores, such as a 4-core processor and an 8-core processor. The processor 601 may be implemented by at least one of hardware forms of a digital signal processor (DSP), a field-programmable gate array (FPGA), and a programmable logic array (PLA). The processor 601 may also include a main processor and a coprocessor. The main processor is a processor for processing data in an awaken state, and is also called as a central processing unit (CPU). The coprocessor is a low-power consumption processor for processing data in a standby state. In some embodiments, the processor 601 may be integrated with a graphics processing unit (CPU), which is responsible for rendering and drawing of content that needs to be displayed on a display screen. In some embodiments, the processor 601 may further include an artificial intelligence (AI) processor configured to process computational operations related to machine learning.

The memory 602 can include one or more computer readable storage mediums, which can be non-transitory. The memory 602 may also include a high-speed random-access memory, and a non-volatile memory such as one or more magnetic disk storage devices and flash memory storage devices. In some embodiments, the non-transitory computer readable storage medium in the memory 602 is configured to store at least one instruction. The at least one instruction is configured to be executed by the processor 601 to implement the method for identifying the display current or the display compensation method according to the method embodiments of the present disclosure.

In some embodiments, the apparatus 600 optionally further includes a peripheral device interface 603 and at least one peripheral device. The processor 601, the memory 602, and the peripheral device interface 603 may be connected by a bus or a signal line. Each peripheral device can be connected to the peripheral device interface 603 by a bus, a signal line, or a circuit board. For example, the peripheral device includes at least one of a radio frequency circuit 604, a display screen 605, a camera component 606, an audio component 607, a positioning component 608, and a power source 609.

The peripheral device interface 603 can be configured to connect at least one I/O (Input/Output)-associated peripheral device to the processor 601 and the memory 602. The radio frequency circuit 604 is configured to receive and transmit an RF (Radio Frequency) signal, also referred to as an electromagnetic signal. The radio frequency circuit 604 communicates with the communication network and other communication devices via the electromagnetic signal. The radio frequency circuit 604 converts the electrical signal into the electromagnetic signal for sending, or converts the received electromagnetic signal into the electrical signal. The display screen 605 is configured to display a UI (User Interface). The UI can include graphics, texts, icons, videos, and any combination thereof. The camera component 606 is configured to capture images or videos. Optionally, the camera component 606 includes a front camera and a rear camera. The audio component 607 may include a microphone and a loudspeaker. The microphone is configured to collect sound waves of the user and the environment, and convert the sound waves into electrical signals for being input to the processor 601 for processing, or being input to the radio frequency circuit 604 for voice communication. The positioning component 608 is configured to position the current geographic location of the apparatus 600 to implement navigation or LBS (Location Based Service). The power source 609 is configured to supply power for various components in the apparatus 600. The power source 609 can be alternating current, direct current, a disposable battery, or a rechargeable battery.

In some embodiments, the apparatus 600 also includes one or more sensors 610. The one or more sensors 610 include, but not limited to, an acceleration sensor 611, a gyro sensor 612, a pressure sensor 613, a fingerprint sensor 614, an optical sensor 615, and a proximity sensor 616.

It will be understood by those skilled in the art that the structure shown in FIG. 6 does not constitute a limitation on the apparatus 600, and may include more or fewer components than those illustrated, or combine some components or adopt different component arrangements.

An embodiment of the present disclosure provides a display apparatus. The display apparatus includes a display compensation apparatus shown in FIG. 6.

The display apparatus provided by the embodiment of the present disclosure may be any product or component having a display function, such as a mobile phone, a tablet computer, a tablet computer, a TV set, a display, a notebook computer, a digital photo frame, a navigator, etc.

The foregoing descriptions are merely optional embodiments of the present disclosure, and are not intended to limit the present disclosure. Within the spirit and principles of the disclosure, any modifications, equivalent substitutions, improvements, etc., are within the protection scope of the present disclosure.

What is claimed is:

1. A method for identifying a display current, comprising:

acquiring grayscales of pixels in a to-be-displayed image, wherein the grayscale of each pixel comprises grayscales of a plurality of color channels;

calculating an average grayscale of a same color channel of all pixels in the to-be-displayed image;

identifying a current value of each color channel and a current offset value of each color channel according to the average grayscale of each color channel, wherein the current offset value represents a difference between a display current value of a nonmonochromatic image and a display current sum of monochromatic images corresponding to the nonmonochromatic image, the monochromatic images corresponding to the nonmonochromatic image being monochromatic images corresponding to color channels required to display the nonmonochromatic image, and the display current sum being a sum of display current values of the monochromatic images; and calculating a display current of the to-be-displayed image based on the current value and the current offset value of each color channel.

2. The method according to claim 1, wherein identifying the current offset value of each color channel according to the average grayscale of each color channel comprises:

identifying a current value corresponding to the average grayscale of each color channel according to a corresponding relationship between a grayscale and a current value, wherein the corresponding relationship between the grayscale and the current value comprises corresponding relationships between the grayscales and the current values of all the color channels; and identifying a current offset value corresponding to the average grayscale of each color channel according to a corresponding relationship between the grayscale and the current offset value, wherein the corresponding relationship between the grayscale and the current offset value comprises corresponding relationships between the grayscales and the current offset values of all the color channels.

3. The method according to claim 2, wherein the grayscale of each pixel comprises grayscales of N+1 color channels, wherein N is an integer greater than 1; and identifying the current offset value corresponding to the average grayscale of each color channel according to the corresponding relationship between the grayscale and the current offset value comprises:

when a quantity of color channels whose average grayscale is 0 is equal to N, identifying that the current offset value of each color channel is 0; and when a quantity of color channels whose average grayscale is 0 is less than N, identifying the current offset value corresponding to the average grayscale of each color channel according to the corresponding relationship between a grayscale and a current offset value.

4. The method according to claim 3, further comprising:

acquiring grayscale test data, wherein the grayscale test data comprises current values for displaying a predetermined color image at predetermined grayscales by sample pixel units on a panel under test;

calculating the current offset values of the color channels at the predetermined grayscales according to the grayscale test data; and performing interpolation and supplementation based on the current offset values of the color channels at the predetermined grayscales, to obtain the current offset values of the color channels at all the grayscales.

5. The method according to claim 2, further comprising:

acquiring grayscale test data, wherein the grayscale test data comprises current values for displaying a predetermined color image at predetermined grayscales by sample pixel units on a panel under test;

calculating the current offset values of the color channels at the predetermined grayscales according to the grayscale test data; and performing interpolation and supplementation based on the current offset values of the color channels at the predetermined grayscales, to obtain the current offset values of the color channels at all the grayscales.

6. The method according to claim 1, wherein calculating the display current of the to-be-displayed image based on the current value and the current offset value of each color channel comprises:

calculating a sum of the current values of all the color channels, to obtain a total channel current;

calculating a sum of the current offset values of all the color channels, to obtain a total current offset value; and calculating a difference between the total channel current and the total current offset value, to obtain the display current of the to-be-displayed image.

7. The method according to claim 1, further comprising:

acquiring grayscale test data, wherein the grayscale test data comprises current values for displaying a predetermined color image at predetermined grayscales by sample pixel units on a panel under test;

calculating the current offset values of the color channels at the predetermined grayscales according to the grayscale test data; and performing interpolation and supplementation based on the current offset values of the color channels at the predetermined grayscales, to obtain the current offset values of the color channels at all the grayscales.

8. The method according to claim 7, wherein the predetermined color image comprises white (W), red (R), green (G), blue (B), cyan (C), magenta (M), and yellow (Y) images, and calculating the current offset values of the color channels at the predetermined grayscales according to the grayscale test data comprises:

calculating the current offset values of the color channels according to the following formulas:

$$\begin{cases} deltaR = (I_R + I_G + I_B - I_W) - (I_G + I_B - I_C) \\ deltaG = (I_R + I_G + I_B - I_W) - (I_R + I_B - I_M), \\ deltaB = (I_R + I_G + I_B - I_W) - (I_R + I_G - I_Y) \end{cases}$$

wherein deltaR is a current offset value of an R channel, deltaG is a current offset value of a G channel, deltaB is a current offset value of a B channel, I_R is a display current value for displaying the R image, I_G is a display current value for displaying the G image, I_B is a display current value for displaying the B image, I_W is a display current value for displaying the W image, I_C is a display current value for displaying the C image, I_M is a display current value for displaying the M image, and I_Y is a display current value for displaying the Y image.

9. A display compensation method, comprising:

identifying a display current of a to-be-displayed image by using the method as defined in claim 1;

obtaining an image compensation grayscale based on the display current of the to-be-displayed image and a corresponding relationship between a display current and an image compensation grayscale; and compensating a picture of a next frame of image of the to-be-displayed image by using the image compensation grayscale.

10. A storage medium, wherein the storage medium comprises at least one instruction, and the at least one instruction is executed by a processor to perform the display compensation method as defined in claim 9.

11. A display compensation apparatus comprising:

a processor and a memory configured to store an instruction executable by the processor, wherein the processor is configured to:

identify a display current of a to-be-displayed image by using the method as defined in claim 1;

obtain an image compensation grayscale based on the display current of the to-be-displayed image and a corresponding relationship between a display current and an image compensation grayscale; and compensate a picture of a next frame of image of the to-be-displayed image by using the image compensation grayscale.

12. A display apparatus comprising the display compensation apparatus as defined in claim 11.

13. An apparatus for identifying a display current, comprising:

a processor and a memory configured to store at least one instruction executable by the processor, wherein the processor is configured to:

acquire grayscales of pixels in a to-be-displayed image, wherein the grayscale of each pixel comprises grayscales of a plurality of color channels;

calculate an average grayscale of a same color channel of all pixels in the to-be-displayed image;

identify a current value of each color channel and a current offset value of each color channel according to the average grayscale of each color channel, wherein the current offset value represents a difference between a display current value of a nonmonochromatic image and a display current sum of monochromatic images corresponding to the nonmonochromatic image, the monochromatic images corresponding to the nonmonochromatic image are monochromatic images corresponding to color channels required to display the nonmonochromatic image, and the display current sum is a sum of display current values of the monochromatic images; and calculate a display current of the to-be-displayed image based on the current value and the current offset value of each color channel.

14. The apparatus according to claim 13, wherein the processor is further configured to:

identify a current value corresponding to the average grayscale of each color channel according to a corresponding relationship between the grayscale and the current value, wherein the corresponding relationship between the grayscale and the current value comprises corresponding relationships between the grayscales and the current values of all the color channels; and identify a current offset value corresponding to the average grayscale of each color channel according to a corresponding relationship between the grayscale and the current offset value, wherein the corresponding relationship between the grayscale and the current offset value comprises corresponding relationships between the grayscales and the current offset values of all the color channels.

15. The apparatus according to claim 14, wherein the grayscale of each pixel comprises grayscales of N+1 color channels, wherein N is an integer greater than 1; and the processor is further configured to:

when a quantity of color channels whose average grayscale is 0 is equal to N, identify that the current offset value of each color channel is 0; and when a quantity of color channels whose average grayscale is 0 is less than N, identify the current offset value corresponding to the average grayscale of each color channel according to the corresponding relationship between the grayscale and the current offset value.

16. The apparatus according to claim 13, wherein the processor is further configured to:

calculate a sum of the current values of all the color channels, to obtain a total channel current;

calculate a sum of the current offset values of all the color channels, to obtain a total current offset value; and calculate a difference between the total channel current and the total current offset value, to obtain the display current of the to-be-displayed image.

17. The apparatus according to claim 13, the processor is further configured to:

acquire grayscale test data, wherein the grayscale test data comprises current values for displaying a predetermined color image at predetermined grayscales by sample pixel units on a panel under test;

calculate the current offset values of the color channels at the predetermined grayscales according to the grayscale test data; and perform interpolation and supplementation based on the current offset values of the color channels at the predetermined grayscales, to obtain the current offset values of the color channels at all the grayscales.

18. The apparatus according to claim 17, wherein the predetermined color image comprises white (W), red (R), green (G), blue (B), cyan (C), magenta (M), and yellow (Y) images, and the processor is configured to calculate the current offset values of the color channels according to the following formulas:

$$\begin{cases} deltaR = (I_R + I_G + I_B - I_W) - (I_G + I_B - I_C) \\ deltaG = (I_R + I_G + I_B - I_W) - (I_R + I_B - I_M); \\ deltaB = (I_R + I_G + I_B - I_W) - (I_R + I_G - I_Y) \end{cases}$$

wherein deltaR is a current offset value of an R channel, deltaG is a current offset value of a G channel, deltaB is a current offset value of a B channel, I_R is a display current value for displaying the R image, I_G is a display current value for displaying the G image, I_B is a display current value for displaying the B image, I_W is a display current value for displaying the W image, I_C is a display current value for displaying the C image, I_M is a display current value for displaying the M image, and I_Y is a display current value for displaying the Y image.

19. A display apparatus comprising the apparatus for identifying a display current as defined in claim 13 or the display.

20. A storage medium, wherein the storage medium comprises at least one instruction, and the at least one instruction is executed by a processor to perform:

acquiring grayscales of pixels in a to-be-displayed image, wherein the grayscale of each pixel comprises grayscales of a plurality of color channels;

calculating an average grayscale of a same color channel of all pixels in the to-be-displayed image;

identifying a current value of each color channel and a current offset value of each color channel according to the average grayscale of each color channel, wherein the current offset value represents a difference between a display current value of a nonmonochromatic image and a display current sum of monochromatic images corresponding to the nonmonochromatic image, the monochromatic images corresponding to the nonmonochromatic image being monochromatic images corresponding to color channels required to display the nonmonochromatic image, and the display current sum being a sum of display current values of the monochromatic images; and calculating a display current of the to-be-displayed image based on the current value and the current offset value of each color channel.

* * * * *